United States Patent [19]

Dragone et al.

[11] Patent Number: 4,482,898

[45] Date of Patent: Nov. 13, 1984

[54] ANTENNA FEED ARRANGEMENT FOR CORRECTING FOR ASTIGMATISM

[75] Inventors: Corrado Dragone, Little Silver; Ralph A. Semplak, Shrewsbury, both of N.J.

[73] Assignee: AT&T Bell Laboratories, Murray Hill, N.J.

[21] Appl. No.: 433,986

[22] Filed: Oct. 12, 1982

[51] Int. Cl.[3] ..... H01Q 19/20; H01Q 19/13

[52] U.S. Cl. ..... 343/781 P; 343/786; 343/839

[58] Field of Search ..... 343/781 P, 781 CA, 761, 343/786, 839, 840

[56] References Cited

U.S. PATENT DOCUMENTS

| | | | |
|---|---|---|---|
| 3,792,480 | 2/1974 | Graham | 343/781 P |
| 3,821,746 | 6/1974 | Mizusawa et al. | 343/781 P |
| 3,828,352 | 8/1974 | Drabowitch et al. | 343/837 |
| 3,922,682 | 11/1975 | Hyde | 343/761 |
| 4,145,695 | 3/1979 | Cans | 343/779 |
| 4,224,626 | 9/1980 | Sternberg | 343/911 |
| 4,339,757 | 7/1982 | Chu | 343/781 P |
| 4,343,004 | 8/1982 | Ohm | 343/781 P |

OTHER PUBLICATIONS

Dragone; An Improved Antenna for Microwave Radio Systems; BSTJ, vol. 53, No. 7, Sep. 1974, pp. 1406–1415.

Acampora et al.; A Satellite System with Limited-Scan Spot Beams, IEEE Trans. on Comm., vol. COM-27, No. 10, 10-79, pp. 1406–1415.

*Primary Examiner*—Eli Lieberman

*Attorney, Agent, or Firm*—Erwin W. Pfeifle

[57] ABSTRACT

The present invention relates to an antenna feed arrangement for correcting for astigmatism caused by an offset main reflector. The feed arrangement comprises at least one feed element, a first and a second cylindrical reflector disposed along the feed axis of the antenna with corresponding axes across the reflecting surfaces thereof oriented orthogonal to each other, and a pair of plates comprising a conductive material which are disposed parallel to, and on either side of, the feed axis of the antenna to enclose the area between the at least one feed element and the first reflector while forming an aperture thereof within a predetermined distance from the second reflector. The feed arrangement components are oriented with respect to each other and the aperture of the antenna to provide separate phase centers with a predetermined spacing therebetween on the feed axis for the two principal planes of curvature of a wavefront illuminating the antenna aperture to correct for astigmatism, which predetermined spacing can be selectively changed.

4 Claims, 4 Drawing Figures

ANTENNA FEED ARRANGEMENT FOR CORRECTING FOR ASTIGMATISM

BACKGROUND OF THE INVENTION

1. Field of the Invention

The present invention relates to an antenna feed arrangement for correcting for astigmatism caused by the main reflector of an antenna.

2. Description of the Prior Art

When a feed is displaced from the focus in a reflector antenna, the loss in efficiency is due primarily from astigmatism which is found to be a different amount at each location of the feed on the focal surface. Antenna systems have been previously devised to correct for certain aberrations including astigmatism.

U.S. Pat. No. 4,145,695 issued to M. J. Gans on Mar. 20, 1979 relates to launcher reflectors which are used with reflector antenna systems to compensate for the aberration of astigmatism which was found to be introduced in the signals being radiated and/or received at the off-axis positions. A major portion of such phase error is corrected by using, with each off-axis feedhorn, an astigmatic launcher reflector having a curvature and orientation of its two orthogonal principal planes of curvature which are chosen in accordance with specific relationships, the launcher reflector being fed by a symmetrical feedhorn.

U.S. Pat. No. 4,339,757 issued to T-S. Chu on July 13, 1982 and U.S. Pat. No. 4,343,004 issued to E. A. Ohm on Aug. 3, 1982 each relate to an antenna arrangement capable of correcting for astigmatism over a broadband range. Each of the patented arrangements comprise a main focusing reflector arrangment, a feed arrangement and an astigmatic correction means disposed between the feed arrangement and the main focusing antenna arrangement. The astigmatic correction means comprises a first and a second doubly curved subreflector disposed in a predetermined manner in the antenna arrangement and which are curved in orthogonal planes to permit the launching and reception of an astigmatic beam of constant size and shape over a broadband range.

The prior art arrangements, however, only compensate for astigmatism for a predetermined off-axis position on the focal surface. Therefore the problem remaining is to provide astigmatic correction feed arrangements which can be easily reoriented on the focal surface of an antenna arrangement and can be adjusted to cancel astigmatism at the new location.

SUMMARY OF THE INVENTION

The foregoing problem has been solved in accordance with the present invention which relates to an antenna feed arrangement for correcting for astigmatism caused by an offset main reflector of an antenna. More particularly, the feed arrangement comprises at least one feed element, a first and a second cylindrical reflector disposed along the feed axis of the antenna with corresponding axes across the reflecting surfaces thereof oriented orthogonal to each other, and a pair of plates comprising a conductive material which are disposed parallel to, and on either side of, the feed axis of the antenna and enclose the area between the at least one feed element and the first cylindrical reflector while extending along the feed axis of the antenna to form an aperture thereof within a predetermined distance from the second cylindrical reflector. The at least one feed element, the first and second cylindrical reflectors and the pair of plates being oriented with respect to the aperture of an antenna, wherein the feed arrangement is to be used, to provide a first and a second phase center for two principal planes of curvature of a wavefront illuminating the aperture of the antenna which are a predetermined distance apart along the feed axis of the antenna to correct for astigmatism.

It is an aspect of the present invention to provide a feed arrangement which can correct for any particular value of astigmatism by the movement of two cylindrical reflectors toward or away from each other along the feed axis of the antenna to change the distance between two phase centers for two principal planes of curvature of a wavefront illuminating the aperture of the antenna wherein the feed arrangement is used.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
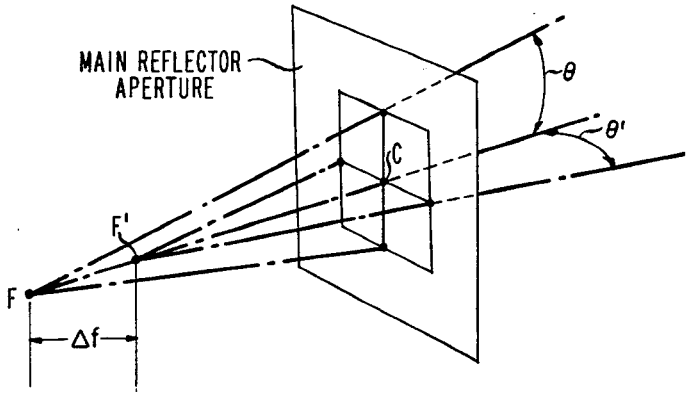
FIG. 1 illustrates the main reflector aperture illuminated by a feed arrangement that provides different phase centers in two principal planes of the aperture illumination.

As was stated hereinbefore, when a feed is displaced from the focus in a reflector antenna, the loss in efficiency due to aberrations is primarily attributed to astigmatism. To better understand this statement and the present invention, the hereinabove-mentioned loss can be eliminated by using a feed with different phase centers in the two principal planes of its beam, as shown in FIG. 1. In order to operate efficiently over a wide range of frequencies, it is desirable that the two phase centers F and F′ and the two associated beam widths $\theta$ and $\theta'$ in FIG. 1 be frequency independent. This can be accomplished by combining a small horn with two cylindrical reflectors, as shown in the article "An Improved Antenna for Microwave Radio Systems Consisting of Two Cylindrical Reflectors and a Corrugated Horn" by C. Dragone in *BSTJ*, Vol. 53, No. 7, September 1974 at pages 1351–1377, and then properly choosing the focal lengths of the two reflectors so as to produce over the main reflector aperture a magnified image of the horn aperture as shown, for example, in the articles "A Satellite System with Limited-Scan Spot Beams" by A. Acampora et al. in *IEEE Trans. on Comm.*, Vol. COM-27, No. 10, October 1979 at pages 1406–1415 and "Satellite Phased Arrays: Use of Imaging Reflectors with Spatial Filtering in the Focal Plane to Reduce Grating Lobes" by C. Dragone et al. in *BSTJ*, Vol. 59, No. 3, March 1980 at pages 449–461.

Such arrangement, however, is not suitable for producing a variable distance Δf between the two phase centers F and F'. In fact if one tries to vary Δf by changing the distances of the two reflectors from the horn, it is found that the beamwidths $\theta$ and $\theta'$ will change, thus causing a decrease in aperture efficiency. This is an important limitation for it implies that a given feed arrangement can only be used for certain locations in the vicinity of the focus since the value of Δf required to correct astigmatism is a function of the feed displacement from the focus. Other undesirable features of the above arrangement are relatively large dimensions for one of the two reflectors and a large feed aperture.

Figure 2:
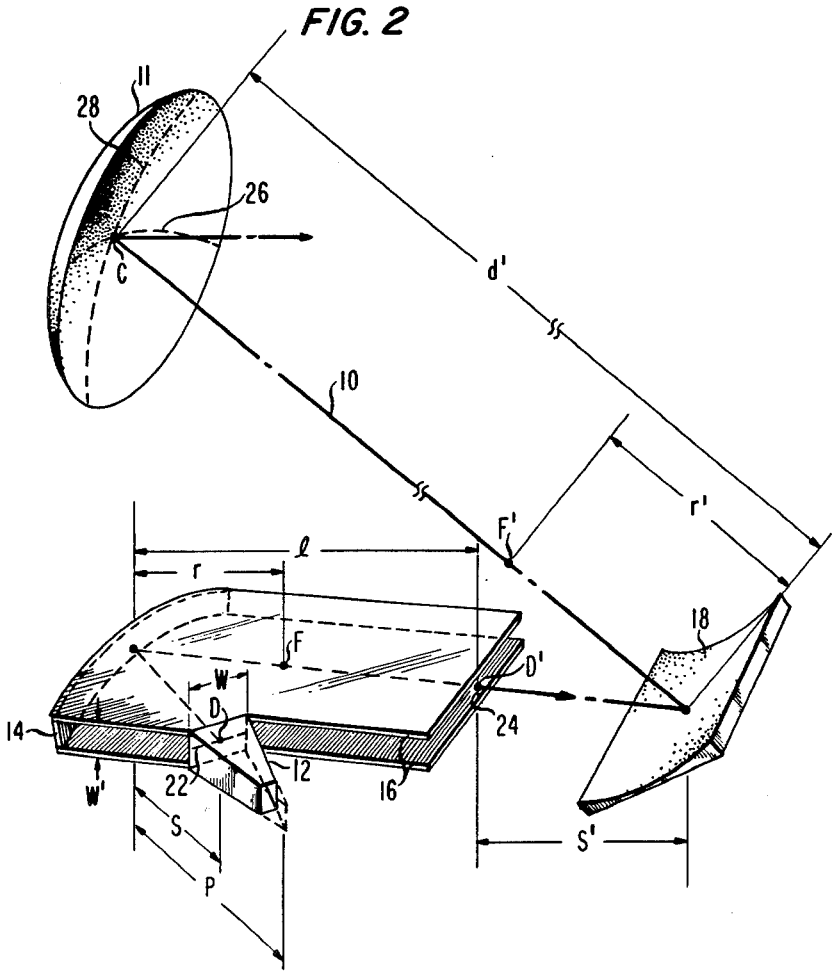
FIG. 2 illustrates a feed arrangement in accordance with the present invention to provide a selectively variable distance between the two phase centers of FIG. 1.

To remove such undesirable features, the above-described arrangement is modified in accordance with the present invention as shown in the arrangement of FIG. 2. In FIG. 2, a feed arrangement is disposed along the feed axis 10 of a curved focusing main reflector 11 comprising a feedhorn 12 and a first cylindrical subreflector 14 located between a pair of parallel plates 16, and a second cylindrical subreflector 18. In this arrangement, the corresponding flat and curved axes across the reflecting surfaces of the first and second cylindrical subreflectors 14 and 18 are disposed orthogonal to each other along feed axis 10. Additionally, the first and second subreflectors 14 and 18 are arranged such that phase center F is disposed between first and second subreflectors 14 and 18 since it is dependent on the curvature of subreflector 14 and the distance of feedhorn 12 from subreflector 14. The second phase center F' is disposed between the second subreflector 18 and main reflector 11 since it is dependent on the curvature of subreflector 18 and the distances of aperture D' at the end of the plates 16 from subreflector 18.

In the arrangement of FIG. 2, the aperture D of feedhorn 12 is disposed at a distance s from first subreflector 14. The wavefront radiated by feedhorn 12 is a cylindrical wavefront guided by the two plates 16. After reflection by the first cylindrical subreflector, the two plates 16 are truncated at a predetermined distance l from the first subreflector 14 and a predetermined fixed distance s' from second subreflector 18. The aperture defined by this truncation of plates 16 is centered at D', with width w' determined by the spacings of the two plates 16, and is illuminated by the cylindrical wavefront produced after reflection by first subreflector 14. The wave radiated by the aperture at D' illuminates second cylindrical subreflector 18. In order to produce, over the main reflector aperture, an image of the aperture of feedhorn 12, the distances s and s' of D and D', respectively, from the two subreflectors 14 and 18 must satisfy the lens equation, which requires $$\frac{1}{S} + \frac{1}{d' + s' + l} = \frac{1}{f} \quad (1)$$

$$\frac{1}{s'} + \frac{1}{d'} = \frac{1}{f'}$$

where f and f' are the focal lengths of the two subreflectors 14 and 18 and d' is the distance of the main reflector 11 from the second subreflector 18. It can be shown that the angular widths $\theta$ and $\theta'$ of the image are given by the equation $$\theta' = \frac{w'}{s'}, \theta = \frac{w}{s} \quad (2)$$

where w' and w are the plate and the feedhorn 12 aperture dimensions, respectively, as shown in FIG. 2.

Figure 4:
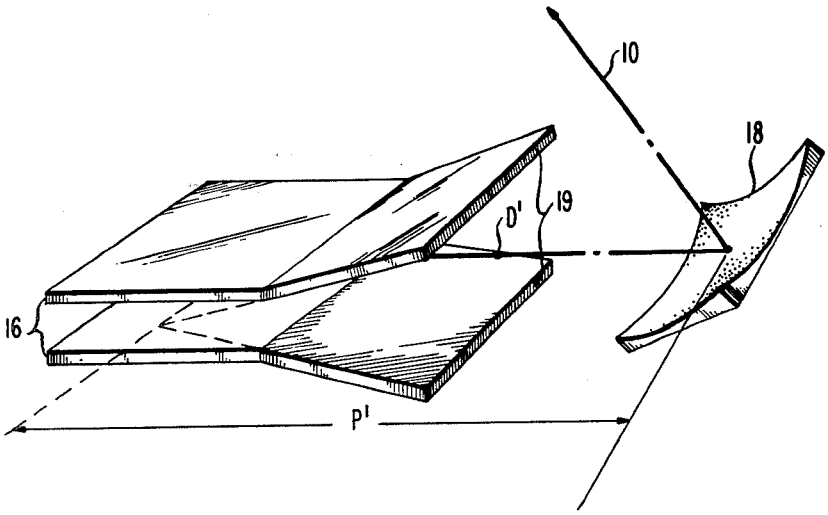
FIG. 4 illustrates parallel plates of FIGS. 2 and 3 comprising a tapered aperture.

The property of the main reflector 11 illumination, obtained with such a feed arrangement, is that its wavefronts have different centers of curvature F and F' in the two principal planes. The location of F and F' are determined by the lens equation. More precisely, let the feedhorn 12 be tapered as shown in FIG. 4 so that its two side-walls intersect each other at a distance p from the first cylindrical subreflector 14. Then the lens equation requires $$\frac{1}{p} + \frac{1}{r} = \frac{1}{f} \quad (3)$$

where r is the distance of phase center F from the first cylindrical subreflector 14. Similarly, for the distance r' of phase center F' from the second cylindrical subreflector 18, $$\frac{1}{r'} + \frac{1}{p'} = \frac{1}{f'} \quad (4)$$

where p'=infinity if the two plates 16 are parallel as in FIG. 2. If, however, the ends 19 of the two plates are tapered as in FIG. 4, then they will intersect each other at a finite distance p' from the second cylindrical subreflector 18.

If p=p'=infinity and the main reflector 11 is at a large distance from feedhorn 12 such that d' is effectively equal to infinity, then $$r=s=f,\ r'=s'=f' \quad (5)$$

and $$\Delta f=l+2f'-f. \quad (6)$$

The value of Δf can be varied without affecting $\theta$ and $\theta'$ by simply changing the distance l of aperture D' of plates 16 from the first reflector 14.

Figure 3:
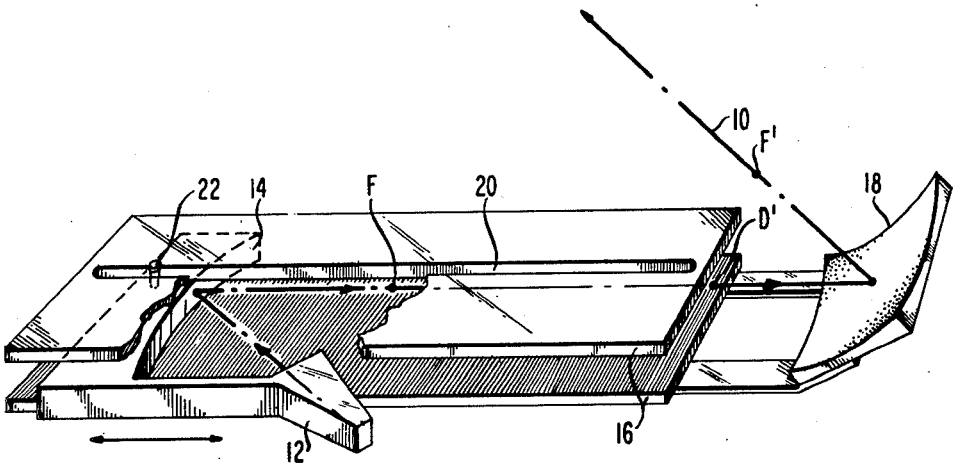
FIG. 3 illustrates a feed arrangement as in FIG. 2 to provide another technique for obtaining a selectively variable distance between the two phase centers of FIG. 1.

A simple arrangement for permitting the distance l of aperture D' to be changed is shown in FIG. 3. There, feedhorn 12 is fixedly mounted to first cylindrical reflector 14 at a predetermined distance s therefrom to provide phase center F at a fixed predetermined distance r from subreflector 14. One or both of plates 16 include a slot 20 therein running parallel to feed axis 10 of the antenna arrangement with first subreflector 14 including a threaded hole for mounting the plates 16 thereto with a screw 22 through slot 20. Therefore, by loosening screw 22, the combination of feedhorn 12 and first subreflector 14 can be moved along slot 20 which correspondingly moves phase center F along feed axis 10 either toward or away from second subreflector 18. Second subreflector 18 is fixedly mounted to plates 16 such that the aperture of the plates 16 at D' is a fixed distance s' from second subreflector 18 which fixes second phase front F' to a predetermined location on feed axis 10. Therefore, by moving the combination of feedhorn 12 and first subreflector 14 along slot 20, the distance Δf between the phase centers F and F' can be varied to correct for different values of astigmatism.

It is to be understood that the above-described embodiments are simply illustrative of the principles of the invention. Various other modifications and changes may be made by those skilled in the art which will embody the principles of the invention and fall within the spirit and scope thereof. For example, feedhorn 12 can comprise one or more feedhorns or feed elements to form a small array, and in FIG. 3 plates 16 can be secured together so that only one slot 20 is required rather than a separate slot for each plate where such plates are not secured together. Furthermore, in the exemplary arrangement of FIG. 2, the present invention does not preclude the use of other subreflectors between second cylindrical subreflector 18 and main reflector 11. It is just to be understood that in the present feed arrangement as illustrated in FIG. 2, the elements of the feed arrangement are oriented such that images of the orthogonal first and second focal lines 26 and 28 corresponding to the principal phases of illumination over the main reflector 11 are formed as lines 22 and 24, respectively, at the respective apertures of feedhorn 12 and plates 16 via respective phase centers F and F'.

What is claimed is:

1. A feed arrangement for use in an antenna, the feed arrangement comprising:

at least one feed element including a predetermined aperture and capable of launching or receiving a beam of electromagnetic energy along a feed axis of the antenna;

a first cylindrical reflector disposed to reflect a beam launched by the at least one feed element along the feed axis of the antenna;

a second cylindrical reflector disposed along the feed axis of the antenna between the first cylindrical reflector and an aperture of the antenna, the flat axes across the first and second cylindrical reflectors being oriented orthogonal to each other along the feed axis of the antenna; and a first and a second plate comprising a conductive material disposed with major exposed surfaces thereof parallel to each other, the first and second plates enclosing the area between two opposing edges of both the at least one feed element and the first cylindrical reflector and extending along the feed axis of the antenna to form an aperture at the ends of the plates which is a predetermined distance from the second cylindrical reflector; the at least one feed element, first and second cylindrical reflectors and the aperture of the plates being oriented with respect to the aperture of the antenna to provide a first and a second phase center for two principal planes of curvature of the wavefront illuminating the aperture of the antenna which are a predetermined distance apart along the feed axis of the antenna.

2. A feed arrangement according to claim 1 wherein the first cylindrical reflector includes a predetermined curvature in a plane parallel to the major exposed surfaces of the first and second plates; and the aperture of the at least one feed element is disposed at a predetermined distance from the first cylindrical reflector for locating the first phase center associated with a first principal plane of curvature of the wavefront illuminating the aperture of the antenna at a predetermined distance from the first reflector and to image an aperture line corresponding to said first principal plane of curvature at the aperture of the at least one feed element.

3. A feed arrangement according to claim 1 or 2 wherein the second cylindrical reflector includes a predetermined curvature in a plane orthogonal to the major exposed surfaces of the first and second plates; and the aperture formed at the ends of the first and second plates is a predetermined distance from the second cylindrical reflector for locating the second phase center associated with a second principal plane of curvature of the wavefront illuminating the aperture of the antenna at a predetermined distance from the second cylindrical reflector and to image an aperture line corresponding to said second principal plane of curvature at the aperture at the ends of the plates.

4. A feed arrangement according to claim 1 or 2 wherein the combination of the at least one feed element and the first cylindrical reflector are fixedly mounted to each other and are selectively movable along the feed axis of the antenna within the area of the first and second plates in a direction towards or away from the second cylindrical reflector.

* * * * *